US005535897A

United States Patent [19]

Gobidas

[11] Patent Number: 5,535,897

[45] Date of Patent: Jul. 16, 1996

[54] DRAPERY ROD WITH WOOD VENEER AND METHOD OF MAKING SAME

[76] Inventor: Raphael A. Gobidas, 2253 Professor St., Cleveland, Ohio 44143

[21] Appl. No.: 34,528

[22] Filed: Mar. 19, 1993

[51] Int. Cl.[6] ..... A47H 1/02

[52] U.S. Cl. ..... 211/105.2; 16/95 W

[58] Field of Search ..... 211/105.1, 105.2; 160/38, 330, 345; 248/251, 261, 262, 231.2; 16/87.4 R, 87.4 W, 94 D, 95 W, 95 D, 95 DW

[56] References Cited

U.S. PATENT DOCUMENTS

| | | | |
|---|---|---|---|
| 563,592 | 7/1896 | Hilliker | 16/87.4 W |
| 2,370,033 | 2/1945 | Hall | 144/309 |
| 2,401,212 | 5/1946 | Wilson | 211/105.1 |
| 2,843,889 | 7/1958 | Keller | 20/74 |
| 3,991,435 | 11/1976 | Ford | 16/94 |
| 4,008,551 | 2/1977 | MacDonald et al. | 52/316 |
| 4,630,420 | 12/1986 | Hagemeyer | 52/313 |
| 4,635,889 | 1/1987 | Bell et al. | 211/105.2 X |
| 4,809,401 | 3/1989 | Honig | 211/105.2 X |
| 4,875,311 | 10/1989 | Meyers | 52/90 |
| 4,881,588 | 11/1989 | Madsen | 160/345 |
| 4,951,576 | 8/1990 | Cobos et al. | 108/131 |

FOREIGN PATENT DOCUMENTS

| | | | |
|---|---|---|---|
| 334755 | 1/1959 | Switzerland | 248/231.2 |
| 10536 | of 1902 | United Kingdom | 211/105.1 |

*Primary Examiner*—Blair Johnson
*Attorney, Agent, or Firm*—Roger D. Emerson

[57] ABSTRACT

A drapery rod includes a substrate covered with a veneer or genuine wood. The substrate is hollow and is preferably made of plastic or metal. The substrate has ribs in an inner surface and has a mounting groove which receives a mounting bracket for mounting said drapery rod to an associated wall. The mounting bracket has opposed prongs which are selectively moveable outwardly from each other for pushing outwardly against an interior surface of the mounting groove to effectively mount said rod to the wall without compressively loading the veneer. The veneer is attached to the outer surface of the substrate via glue. The rod features a slot in an outer surface of the veneer which receives a decorative strip. The rod also includes a pair of returns which also have substrates and veneers similar to said drapery rod and which are oriented generally perpendicularly to the drapery rod at each end thereof. The rod also includes two corners which join the returns with one of the ends of said drapery rod. The corners are made of solid wood.

5 Claims, 3 Drawing Sheets

DRAPERY ROD WITH WOOD VENEER AND METHOD OF MAKING SAME

BACKGROUND OF THE INVENTION

1. Field of Invention

This invention pertains to the art of drapery rods, cornices, and similar window and door covering devices, and more particularly to a drapery rod with a veneer made of high quality genuine wood.

2. Description of the Related Art

Drapery rods have been known in the art for many years. For example, U.S. Pat. No. 2,401,212 to Wilson discloses a curtain rod with supporting brackets. More recently, U.S. Pat. No. 3,991,435 to Ford discloses a decorative traverse rod having a modular decorative facing. While the rod is made of metal, the facing preferably made of molded plastic material. Although current drapery rods, such as that disclosed in Ford, generally are made of metal to have sufficient strength to support the draperies, the plastic veneer which is sometimes used is not attractive for some applications. The plastic generally cannot be painted to match the color scheme of the room. Further, in some applications a wood grain is desired and therefore the plastic is generally unsuitable. For example, it seldom looks like genuine wood and cannot be stained to match other wood trim in the room.

For these applications, consumers have desired genuine wood drapery rod. However, since the drapery rod can span an considerable expanse, it must be made of solid wood to bear the weight of the draperies. In addition, the wood must be of a surface high quality since the decorative drapery rod is highly visible and important to the attractiveness of the home's interior. Because of the high quality of wood required, drapery rods made of solid wood have been expensive and generally available to only a few consumers able to pay for them.

From an environmental standpoint, the plastic drapery rods were much preferable to the solid wood rods. Large quantities of wood were required to find a section of wood with the high quality surface necessary for the drapery rod.

Because of the prohibitive cost, as well as the above-discussed environmental factors, some interior designers have sought to laminate an inexpensive substrate such as plastic or metal with a veneer of plastic or film onto which a wood grain appearance had been formed. These embodiments had the disadvantage of being unable to be sanded, painted or stained to match other woodwork in the room. In addition, the veneer often was dislodged from the substrate below by the operation of mounting brackets which gripped the exterior of the rod and compressed it.

The present invention contemplates an new and improved drapery rod which is simple in design, effective in use, and overcomes many of the foregoing difficulties and others while providing better and more advantages overall results. The invention requires only a small portion of genuine wood, thus saving and preserving trees. In addition, it can be successfully manufactured of low-grade plastic such as recycled plastic, thus reducing waste in landfills as well as saving trees.

SUMMARY OF THE INVENTION

In accordance with the present invention, a new and improved drapery rod is provided which is strong enough to support draperies while providing an attractive real wood exterior surface at a lower cost than prior art devices.

More particularly, in accordance with the invention, the drapery rod comprises a substrate which is made of plastic or metal. The substrate is covered with a thin veneer made of a natural fiber, preferably genuine wood. The veneer is attached to the substrate through an attaching means which is preferably a glue or adhesive.

According to another aspect of the invention, a drapery rod comprises a substrate, said substrate being generally hollow and having an outer surface and an inner surface, said substrate being made of plastic and having ribs in said inner surface, said substrate further comprising a mounting groove, said mounting groove selectively receiving a mounting bracket for mounting said drapery rod to an associated wall, said mounting bracket having opposed prongs which are selectively moveable outwardly from each other for pushing outwardly against an interior surface of said mounting groove to effectively mount said rod to said associated wall without said mounting bracket compressively loading said veneer;

a veneer, said veneer being attached to said outer surface of said substrate, said veneer being made of wood, said opposed prongs of said mounting bracket pushing outwardly against said interior surface of said mounting groove to effectively mount said rod to said associated wall without compressively loading said veneer;

an attaching means for attaching said veneer to said outer surface of said substrate, said attaching means being glue;

a slot, said slot being in an outer surface of said veneer and adapted to receive a decorative strip;

a pair of returns, said returns having substrates and veneers similar to said drapery rod and being oriented generally perpendicularly to said drapery rod at each end thereof; and, two corners, each of said corners joining one of said returns with one of said ends of said drapery rod, each of said corners being made of solid wood.

One advantage of the present invention is a provision of a new drapery rod which has strength to support the weight of draperies while having an attractive veneer surface which is made of genuine wood.

Another advantage of the invention is the light weight of the drapery rod due to it being hollow and being made of plastic or metal.

Another advantage of the invention is the improved strength due to the provision of strengthening ribs in the interior of the substrate.

Another advantage of the invention is the provision of a genuine wood exterior which may be sanded and stained to match the existing wood in the home.

Another advantage of the invention is the environmental benefits obtainable thereby. Less wood is used, thereby saving trees. Recycled plastic can be used for the substrate, thus recycling materials destine for a landfill.

Still further benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof in wherein.

DESCRIPTION OF THE PREFERRED EMBODIMENT

Figure 1:
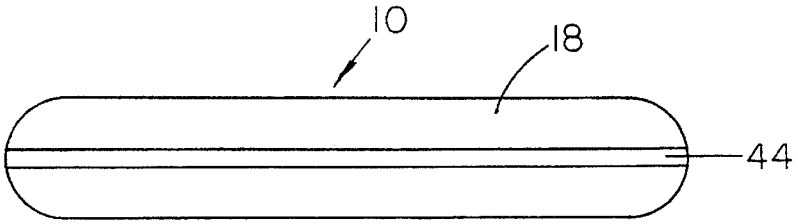
FIG. 1 is a front view of a drapery rod according to the invention.

Referring now to the drawings where the showings are for purposes of illustrating a preferred embodiment of the invention only and not for purposes of limiting the claims, FIG. 1 shows a front view of a center section of a drapery rod 10 according to the invention.

With reference to FIGS. 2–5, a cross-sectional end view of the rod 10 is shown. In each of these embodiments, a substrate 14 is preferably made of plastic or metal. The substrate 14 is covered with a thin veneer 18 made of a natural fiber, preferably wood. The thickness of the veneer 18 is preferably 1/32" to 1/8. One source of the veneer 18 is Creative Products of Jeffersonville, Ind.

The veneer 18 is attached to an outer surface 22 of the substrate 14 by means of an attaching means, preferably glue. One preferred glue is hot-melt Jowat adhesive applied in an automatic wrapping process. This process has been successfully performed by personnel at Creative Products of Jeffersonville, Ind.

Although the basic embodiment of the invention is contained in each of the embodiments shown in FIGS. 2–5, each has advantages which might be applicable to certain applications.

Figure 2:
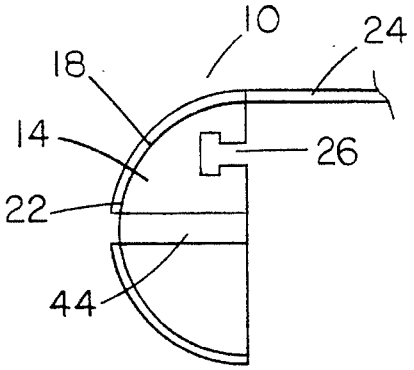
FIG. 2 is an end view of a drapery according to the invention.

In the embodiment shown in FIG. 2, the rod 10 features a mounting groove 26 in the back of the substrate 14. The operation of this mounting groove 26 will be described in more detail later in this specification. In this embodiment, a deck 24 is shown, as such are utilized with vertical blinds (not shown). The rod 10 can easily be mounted to the deck 24 in such application. A slot 44 is shown extending across the front of the rod 10 and around a return 62. The function of the slot 44 and return 62 will be discussed later in this specification.

Figure 3:
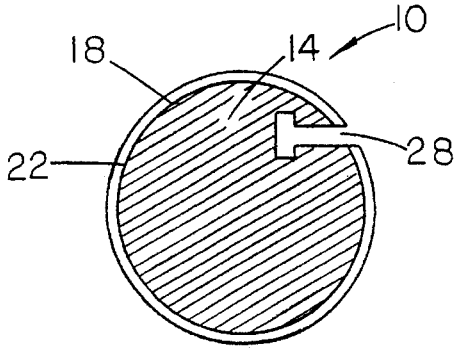
FIG. 3 is a cross-sectional end view of a second embodiment of a drapery rod according to the invention.

With reference to FIG. 3 another embodiment of the rod 10 is disclosed. In this embodiment, the rod 10 comprises a nearly solid substrate 18, having a void only for a mounting groove 28.

Figure 4:
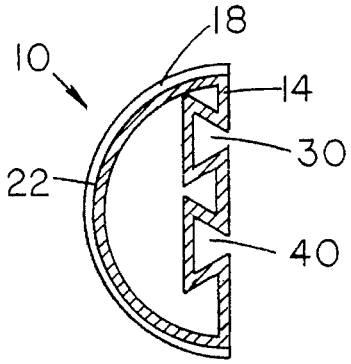
FIG. 4 is a cross-sectional side view of a third embodiment drapery rod according to the invention.

With reference to FIG. 4, another embodiment of the invention shows a semi-circular rod 10. This embodiment includes a triangularly-shaped mounting groove 30 in addition to a second triangularly-shaped groove 40 which can receive a traverse rod (not shown) or a VECLRO® strip.

Figure 5:
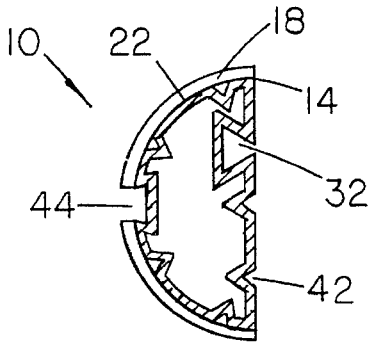
FIG. 5 is a cross-sectional end view of a fourth embodiment of a drapery rod according to the invention.

In the embodiment shown in FIG. 5, the rod 10 is also generally semi-circular and still includes a mounting groove 32. This embodiment further includes internal ribs 42 for strengthening the rod 10. The ribs 42 are shown running along the axis of the rod 10. In other embodiments, the ribs can run perpendicular to or around the axis of the rod 10. An important feature of this embodiment, as well as the embodiment shown in FIG. 2, is decorative slot 44 which is located near the middle of the rod 10. The decorative slot 44 is also shown in FIG. 1. The decorative slot 44 can receive a decorative strip (not shown) to add to the decorative look of the rod 10 or coordinate with the room's decor. For example, the decorative strip can be brass or chrome. Other embodiments include a fabric strip to match the curtains, paint, or furniture of the room.

Figure 8:
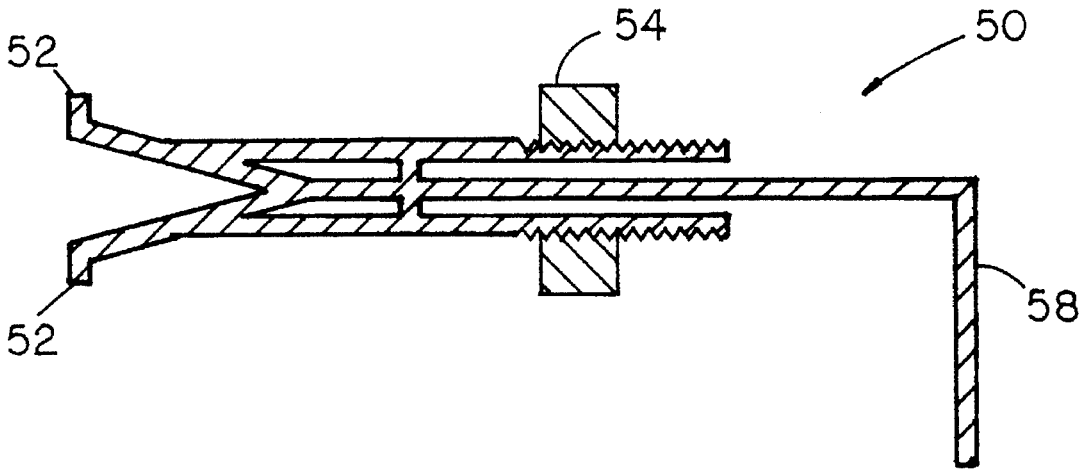

With reference to FIG. 8, a mounting bracket 50 is shown. The mounting bracket 50 features opposed prongs 52 which move outwardly from each other upon rotation of thumb screw 54. The mounting bracket 50 includes a flat surface 58 which fixedly mounted to an associate wall 66. The opposed prongs 52 can be fitted into the mounting grooves 26, 28, 30, 32 and 34 of the rod 10 and the thumb screw 54 rotated until the opposed prongs 52 press outwardly against interior walls of the mounting groove 26,28,30,32. This feature is important to the successful application of the veneer 18 to the substrate 14. In prior art designs, the outer portions of the rod 10 would commonly be compressively gripped by a mounting bracket. In such cases, the compressive stress placed on the veneer and the substrate would cause the two to separate from each other. The design shown herein places tensile stress on the interior of the substrate and never places stress on the veneer 18 or on the interface between the veneer 18 and the substrate 14. This mounting procedure is significant improvement over other designs and is a important contribution to the successful attachment of a thin wood veneer 18 to a plastic or metal substrate 14.

Another important advantage of this mounting bracket is the hidden nature of it. From the front of the drapery, the mounting bracket 50 is invisible.

In another embodiment, mounting grooves 26, 28, 30, 32 in addition to groove 40 can received a strip of hook and loop material, such as is sold under the tradename VELCRO®. The corresponding piece of hook and loop strip can be sewn to the draperies themselves, providing an easy way to hang the draperies.

Figure 6:
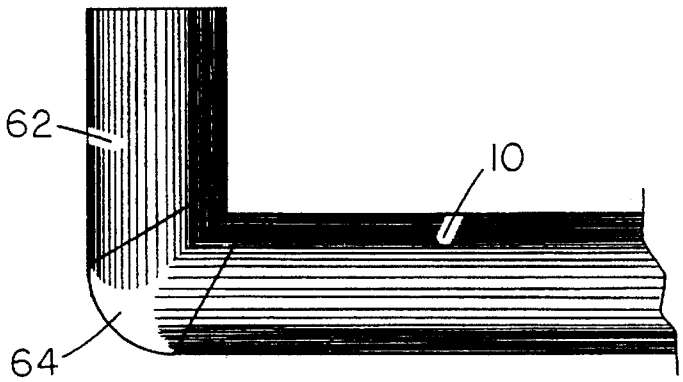
FIG. 6 is a end view of a portion of a drapery rod according to the invention.
Figure 7:
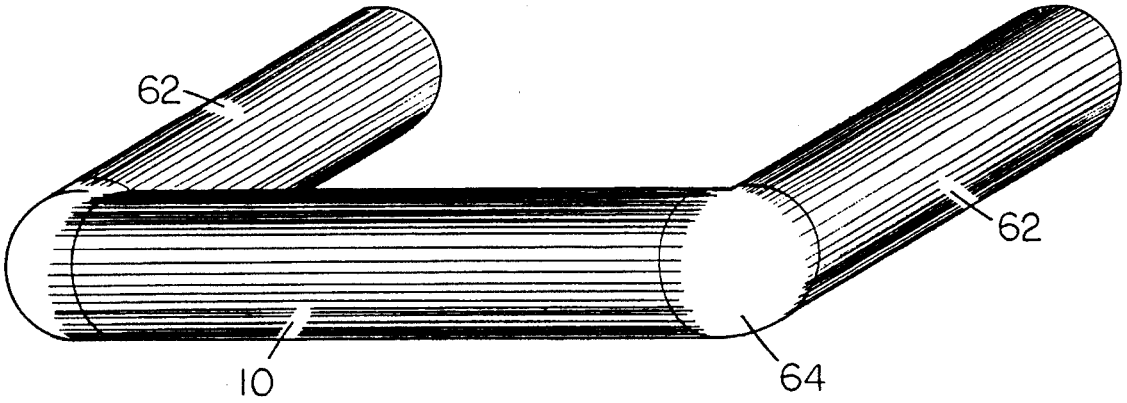
FIG. 7 is a perspective front view of a drapery rod and returns according to the invention; and, FIG. 8 is a side view of a bracket according to the invention.

With reference to FIGS. 6 and 7, another common problem in the prior art concerned returns 62 and corners 64. The returns 62 are that portion of the rod 10 which is perpendicular to the associated wall 66 and which hide from view the back of the draperies and any traverse rod in back of the draperies. The corners 64 are those portions which connect the returns 62 to the rod 10.

It is commercially difficult, or perhaps impossible, to successfully apply a veneer to a doubly curved surface, such as one of the corners 64. For this reason, the invention incorporates corners 64 made of solid wood. This is the only portion of the invention made of solid wood, so costs and weight are still kept low.

By matching the veneer 18 which is used on the returns 62 and on the drapery rod 10 to the solid wood corners 64, the entire drapery rod 10, corner 64 and return 62 combination can be made to look as if it was a single piece of solid wood. If necessary or desirable, a small piece of tape having a wood grain outer surface and adhesive covered inner surface can be applied to the outer surface of the joints between the return 62 and the corner 64 and drapery rod 10 to smooth the interface.

Another important advantage of the invention is the ability to exactly match the returns 62 to the drapery rod 10 by forming the returns 62 along with the rod 10. For example, the rod 10 can be made in widths as long as fourteen feet. If an application called for a rod of ten foot width and six inch returns, the rod could be made in an eleven foot length. By cutting six inch lengths from each end of the rod, six inch returns could be made which exactly match the wood grain and color of the rod itself.

The invention has been described with reference to a preferred embodiment. Obviously, modifications and alterations will occur to others upon a reading and understanding of this detailed specification. It is intended to include all such alterations and modifications insofar as they come within the scope of the appended claims or the equivalents thereof.

Having thus described the invention, it is now claimed:

1. A drapery rod comprising:

a substrate, said substrate having an outer surface;

a veneer, said veneer being attached to said outer surface of said substrate, said veneer being made of a natural fiber;

an attaching means for attaching said veneer to said outer surface of said substrate; and, a slot, said slot being in an outer surface of said veneer and adapted to receive a decorative strip.

2. A device for hanging draperies, the device having two returns and a center section, said returns and center section comprising:

a cylindrical substrate, said substrate being made of plastic and having an outer surface;

a wood veneer, said wood veneer fixedly attached to said substrate via an adhesive means; and, said device further comprising:

two corners, each of said corners joining one of said returns with an end of said center section, each of said corners being made of solid wood.

3. The device of claim 2 wherein said device further comprises:

tape, said tape having an outer surface and an inner surface, said inner surface being coated with an adhesive which selectively affixes said tape to an outer surface of said veneer and one of said corners, said outer surface of said tape having a decorative pattern.

4. The device of claim 3 wherein said decorative pattern of said tape is wood grain to match the appearance of said veneer and corners.

5. A drapery rod comprising:

a substrate, said substrate being generally hollow and having an outer surface and an inner surface, said substrate being made of plastic and having ribs in said inner surface, said substrate further comprising a mounting groove, said mounting groove selectively receiving a mounting bracket for mounting said drapery rod to an associated wall, said mounting bracket having opposed prongs which are selectively moveable outwardly from each other for pushing outwardly against an interior surface of said mounting groove to effectively mount said rod to said associated wall without said mounting bracket compressively loading said veneer;

a veneer, said veneer being attached to said outer surface of said substrate, said veneer being made of wood, said opposed prongs of said mounting bracket pushing outwardly against said interior surface of said mounting groove to effectively mount said rod to said associated wall without compressively loading said veneer;

an attaching means for attaching said veneer to said outer surface of said substrate, said attaching means being glue;

a slot, said slot being in an outer surface of said veneer and adapted to receive a decorative strip;

a pair of returns, said returns having substrates and veneers similar to said drapery rod and being oriented generally perpendicularly to said drapery rod at each end thereof; and, two corners, each of said corners joining one of said returns with one of said ends of said drapery rod, each of said corners being made of solid wood.

* * * * *